US007749029B1

(12) United States Patent
Pontillo, II

(10) Patent No.: US 7,749,029 B1
(45) Date of Patent: Jul. 6, 2010

(54) HIGH CURRENT ELECTRICAL CONNECTOR WITH FLAT CONNECTOR PINS

(76) Inventor: James V. Pontillo, II, 1752 Meadowlark La., Anaheim, CA (US) 92806

( * ) Notice: Subject to any disclaimer, the term of this patent is extended or adjusted under 35 U.S.C. 154(b) by 0 days.

(21) Appl. No.: 12/407,255

(22) Filed: Mar. 19, 2009

Related U.S. Application Data

(60) Provisional application No. 61/038,651, filed on Mar. 21, 2008.

(51) Int. Cl.
*H01R 13/64* (2006.01)

(52) U.S. Cl. ..... 439/678; 439/677

(58) Field of Classification Search ..... 439/677–678, 439/679, 680, 682, 692
See application file for complete search history.

(56) References Cited

U.S. PATENT DOCUMENTS 3,477,001 A * 11/1969 Haas et al. ..... 318/749
4,932,902 A * 6/1990 Crane, Jr. ..... 439/627
5,108,311 A * 4/1992 Nakazawa ..... 439/607.32
5,533,915 A 7/1996 Deans
7,374,460 B1 * 5/2008 Hariharesan et al. ..... 439/679

* cited by examiner

*Primary Examiner*—Michael C Zarroli
(74) *Attorney, Agent, or Firm*—Blakely Sokoloff Taylor & Zafman LLP

(57) ABSTRACT

A connector suitable for use in relatively high current applications such as encountered in certain battery operated devices. The connector uses molded male and female connector members that include flat connector pins, the male connector pins being inserted into the female connector member to make contact with the female connector pins. The female connector member has spaces for receiving the male connector pins that have minimum gaps of less than the thickness of the male connector pin, as defined by an elastic wall of the female connector member. The elastic walls deflect on insertion of the male connector pins and maintain a force holding the male connector pins in good contact with the female connector pins.

14 Claims, 4 Drawing Sheets

HIGH CURRENT ELECTRICAL CONNECTOR WITH FLAT CONNECTOR PINS

CROSS-REFERENCE TO RELATED APPLICATION

This application claims the benefit of U.S. Provisional Patent Application No. 61/038,651 filed Mar. 21, 2008.

BACKGROUND OF THE INVENTION

1. Field of the Invention

The present invention relates to the field of connectors.

2. Prior Art

U.S. Pat. No. 5,533,915 discloses a connector suitable for use in relatively high current applications such a encountered in certain battery operated devices. The connector is a two conductor connector configured to avoid the possibility of being plugged in backward, and having beryllium copper spring members on each male conductor to force the male conductor against the female conductor on insertion of the male connector part into the female connector part.

DETAILED DESCRIPTION OF THE PREFERRED EMBODIMENTS

The purpose of the present invention is provide a connector of the type of U.S. Pat. No. 5,533,915 at a lower manufacturing cost. Because of certain similarities between the connector of the present invention and that of U.S. Pat. No. 5,533,915, the disclosure of U.S. Pat. No. 5,533,915 is hereby incorporated herein by reference.

Figure 1:
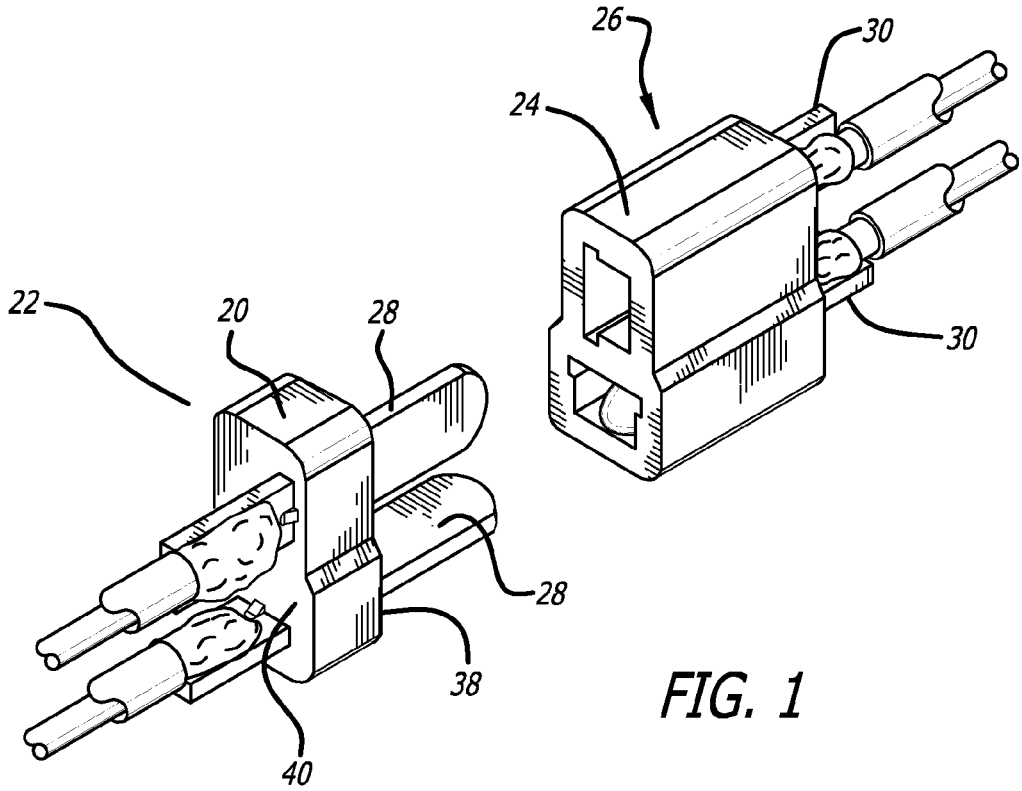
FIG. 1 is a perspective view illustrating the connector of the present invention.

FIG. 1 is a perspective view illustrating the connector of the present invention. The body 20 of the male connector member 22 and the body 24 of the female connector member 26 are molded of a relatively rigid, high strength and low creep plastic such as polysulfone, or a glass filled plastic such as nylon. Assembled within the male connector member are two conductor pins 28 and within the female connector member are two additional conductor pins 30 to complete the conductor.

Figure 5:
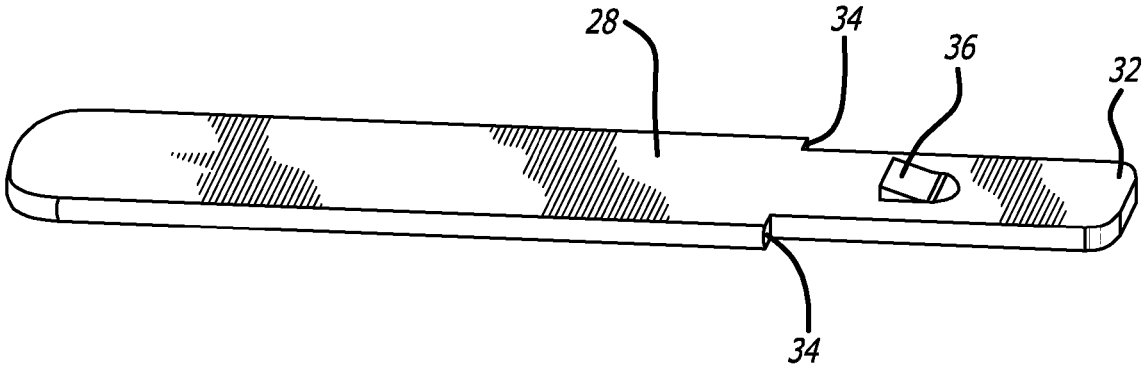
FIG. 5 is a perspective view of a male conductor pin.
Figure 6:
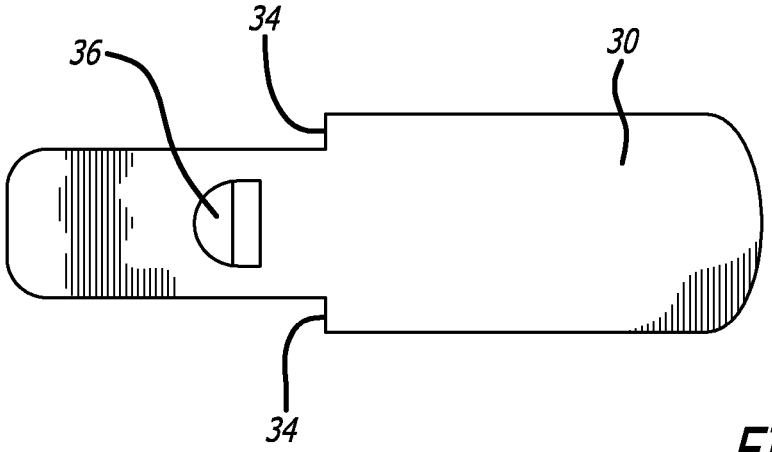
FIG. 6 is a plan view of a female conductor pin.

A typical conductor pin for the male connector member may be seen in FIG. 5. This conductor pin is a flat elongate conductor of a substantially uniform thickness having a rounded end 32 stepped down in width to define shoulders 34, and slit and locally bent to define a tab 36 having a free end facing shoulders 34. A typical conductor pin 30 for the female connector member is similar, though shorter, and somewhat wider than the male conductor pin, as may be seen in FIG. 6.

The body 20 of the male connector member 22 is molded with slots extending through the body to receive the male conductor pins. Each slot has a cross section at end 38 that is equal to or very slightly larger than the cross section of the wider part of the conductor pin 28, though steps down in cross section near end 40 to a cross section less than the cross section of the wider part of the conductor pin 28, but equal to or very slightly larger than the cross section of the narrower part of the conductor pin. Thus each male conductor pin may be inserted into the body 20 from end 38 until the shoulders 34 rest on the step-down in cross section of the respective slot in the body member. The conductor pins 28 and the male body member 20 are relatively proportioned so that when shoulders 34 rest on the step-down in cross section of the respective slot in the body member, the tab 34 extends slightly beyond end 40 of the body member. The tab may be proportioned to be a spring tab, springing out on insertion, or be designed to be forceably bent outward after insertion. Either way, the tab prevents the conductor pin from being pulled out of the body member when the connector is disconnected.

Figure 2:
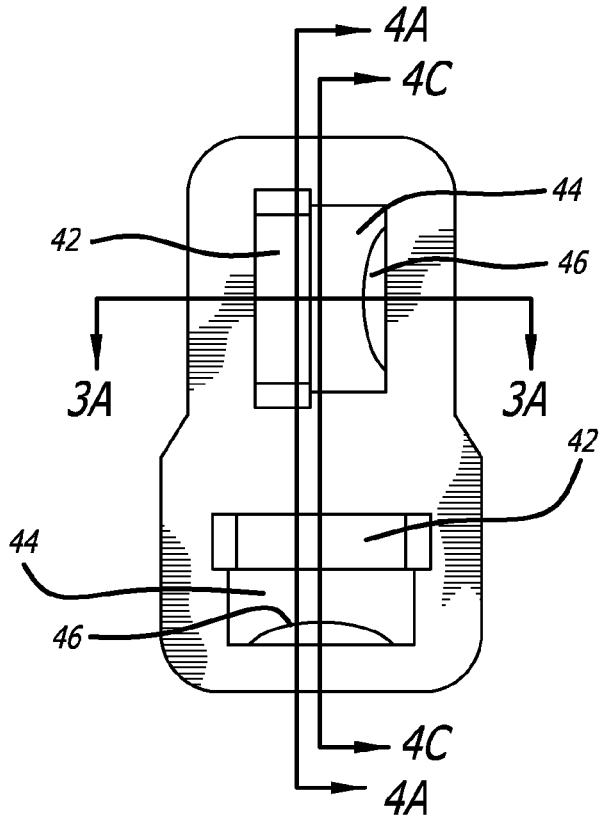
FIG. 2 is an end view of the female connector body.
Figure 3A:
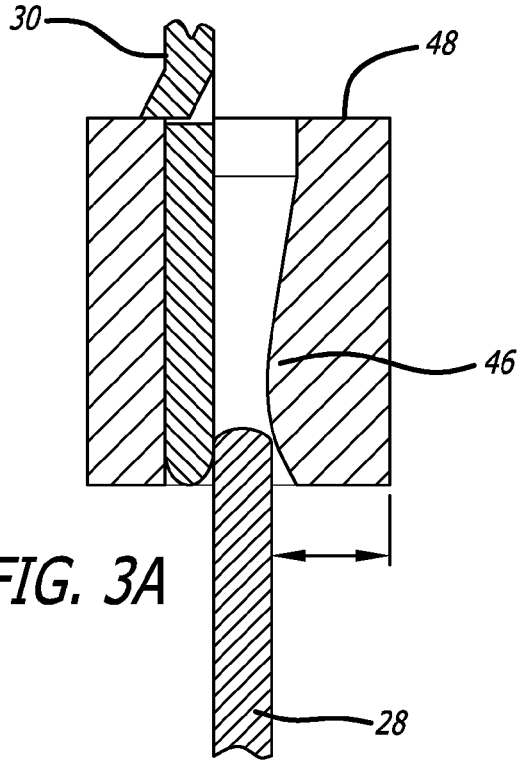
FIGS. 3*a*, 3*b*, 4*a*, 4*b*, and 4*c* are cross sections taken through the female connector body.
Figure 3B:
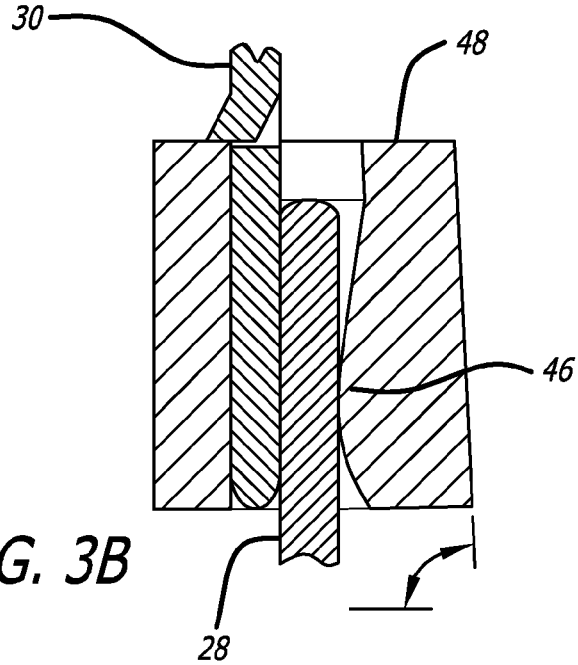
Figure 4A:
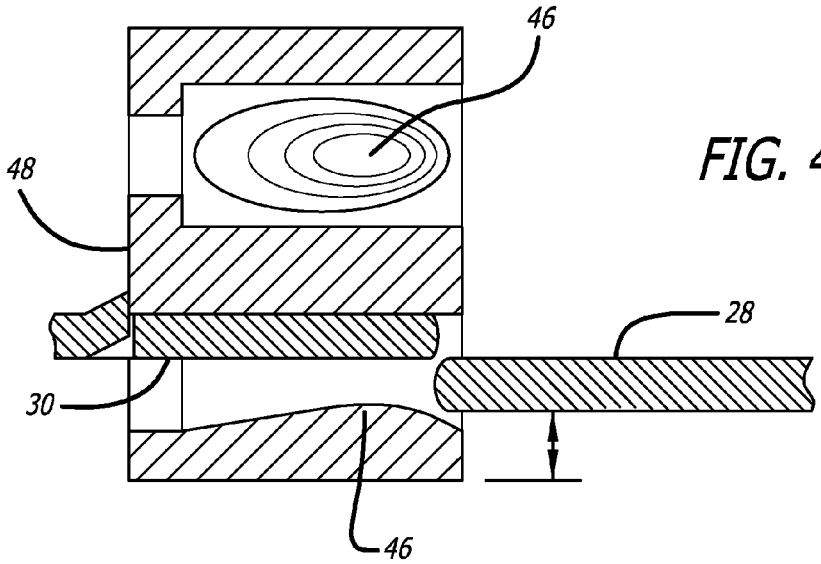
Figure 4B:
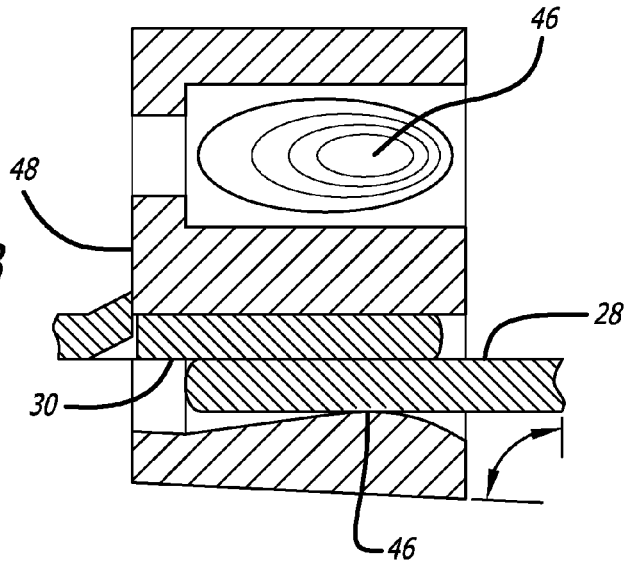
Figure 4C:
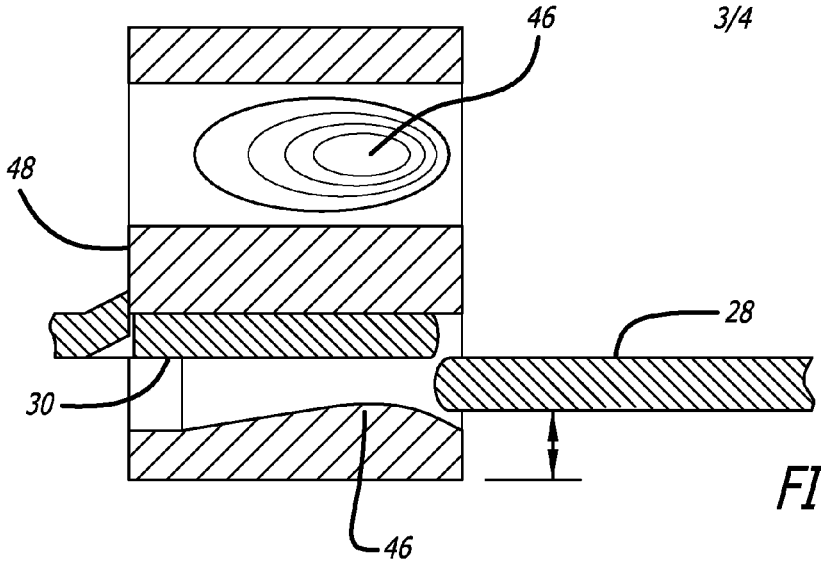

FIG. 2 is an end view of the female body member 24. The female body member is somewhat similar to the male body member 20, though has some very substantial differences. Slots 42 extend through the body member, stepping down in width part way through the body member. Integral therewith and adjacent slots 42 are somewhat narrower slots 44. These slots are for receiving the outward extending ends of the conductor pins 28 of the male connector member. The somewhat wider slots 42 are for receiving and retaining the female conductor pins 30, both of which are purposely made somewhat wider than the ends of the male conductor pins so as to be received and retained in the wider slot 44 without falling into the narrower slot.

It will be noted that the narrower slot 42 has a bump 46 on the side of slot 44 opposite slot 42. This bump is also shown in FIGS. 3*a*, 3*b*, 4*a*, 4*b*, and 4*c*, showing cross sections through each of the slots with the male and female connector portions engaged. As may be seen, bump 46 is a local bump, in that it extends only part way across the slot, and similarly extends only part way along the depth of the slot, preferably being centered a bit closer to the open or engagement end of the female body member 24.

The bump projects from the wall of slot 44 so as to provide a slight interference fit of the male conductor pin 28 into slot 42, forcing the male conductor pin into firm contact with female conductor pin 30. However since the bump is localized, and on an outside wall of the conductor member 24, the wall may flex outward as required to allow the male conductor pin to slide into full engagement in the female connector member. By suitably rounding (or even tapering if desired) the ends of the male conductor pins, the ends of the male conductor pins may force themselves between the top of the bumps and the adjacent female conductor pins without damage of the pins or bumps. This causes the walls of the connector body 26 to elastically flex outward as the male conductor pins are forced against the respective female conductor pins for a positive electrical contact between the two pairs of conductor pins.

Preferably the bumps 46 are relatively local, and have a top that is located away from the end wall of the connector body 24, as shown in FIGS. 3*a*, 3*b*, 4*a*, 4*b*, and 4*c*. For molding purposes, it is most convenient to leave at least part of ends 48 open to provide access for a mold member to define that side of the bumps. Leaving the ends open for the height of the bumps also makes the walls supporting the bumps more flexible.

While a preferred embodiment of the present invention has been disclosed and described herein for purposes of illustration and not for purposes of limitation, it will be understood by those skilled in the art that various changes in form and detail may be made therein without departing from the spirit and scope of the invention.

What is claimed is:

1. A connector assembly comprising:

a male connector member and a female connector member;

the male connector member having a first flat male connector pin extending from a male connector body;

the female connector member having a first flat female connector pin and a molded plastic female connector body that includes a first slot to receive and retain the first flat female connector pin against a first wall and a second slot connected to the first slot for receiving the first flat male connector pin, the second slot including a second elastic wall that is spaced apart from the first flat female connector pin such that the first flat male connector pin is received in the space between the first flat female connector pin and the second elastic wall, the second elastic wall including a bump molded as part of the second elastic wall and extending toward the first female connector pin such that the bump causes the second elastic wall to elastically flex outward as the first flat male connector pin is received in the space between the first flat female connector pin and the second elastic wall.

2. The connector assembly of claim 1 further comprising a second flat male connector pin extending from a male connector body and a second flat female connector pin retained in the female connector body, and the two male connector pins are disposed so as to be insertable into the female connector member only one way.

3. The connector assembly of claim 2 wherein the two male connector pins are disposed 90 degrees from each other.

4. The connector assembly of claim 1 wherein the male and female connector members are molded members, with the connector pins not being molded in.

5. The connector assembly of claim 4 wherein two ends of the second slot are at least partially open for access of a mold member to define the bump during molding of the female connector member.

6. The connector assembly of claim 1, wherein at least a portion of the first slot is somewhat wider than the second slot such that first flat female connector pin will not fall into the second slot.

7. The connector assembly of claim 1, wherein the second elastic wall is part of an exterior wall of the female connector body.

8. A female connector comprising:

a first flat female connector pin; and a molded plastic female connector body that includes a first slot to receive and retain the first flat female connector pin against a first wall and a second slot connected to the first slot for receiving a first flat male connector pin, the second slot including a second elastic wall that is spaced apart from the first flat female connector pin such that the first flat male connector pin can be received in the space between the first flat female connector pin and the second elastic wall, the second elastic wall including a bump molded as part of the second elastic wall and extending toward the first female connector pin such that the bump causes the second elastic wall to elastically flex outward as the first flat male connector pin is received in the space between the first flat female connector pin and the second elastic wall.

9. The female connector of claim 8, further comprising a second flat female connector pin, the first and second flat female connector pins being disposed such that corresponding flat male connector pins can be received in only one way.

10. The female connector of claim 9 wherein the first and second flat female connector pins are disposed 90 degrees from each other.

11. The female connector of claim 8, wherein the first flat female connector pin is not molded into the molded plastic female connector body.

12. The female connector of claim 8, wherein the two ends of the second slot are at least partially open for access of mold members to define the bump during molding of the female connector body.

13. The female connector of claim 8, wherein at least a portion of the first slot is somewhat wider than the second slot such that first flat female connector pin will not fall into the second slot.

14. The female connector of claim 8, wherein the second elastic wall is part of an exterior wall of the female connector body.

* * * * *